US007422665B2

(12) United States Patent
Whitmore

(10) Patent No.: US 7,422,665 B2
(45) Date of Patent: Sep. 9, 2008

(54) ANODE FOR CATHODIC PROTECTION

(76) Inventor: David Whitmore, 38 King Dr., Winnipeg, Manitoba (CA) R3T 3E5

( * ) Notice: Subject to any disclaimer, the term of this patent is extended or adjusted under 35 U.S.C. 154(b) by 0 days.

(21) Appl. No.: 11/370,167

(22) Filed: Mar. 8, 2006

(65) Prior Publication Data

US 2007/0209949 A1 Sep. 13, 2007

(51) Int. Cl.
*C23F 13/10* (2006.01)

(52) U.S. Cl. ..... 204/196.18; 204/196.22; 204/196.23; 204/196.24; 204/196.25; 204/196.37

(58) Field of Classification Search ..... 205/734, 205/740; 204/196.18, 196.22, 196.23, 196.24, 204/196.25, 196.36, 196.37
See application file for complete search history.

(56) References Cited

U.S. PATENT DOCUMENTS

| | | | | |
|---|---|---|---|---|
| 5,292,411 | A | 3/1994 | Bartholomew et al. | |
| 5,968,339 | A * | 10/1999 | Clear | 205/730 |
| 6,033,553 | A | 3/2000 | Bennett | |
| 6,165,346 | A | 12/2000 | Whitmore | |
| 6,303,017 | B1 * | 10/2001 | Page et al. | 205/734 |
| 6,572,760 | B2 | 6/2003 | Whitmore | |
| 6,793,800 | B2 | 9/2004 | Whitmore | |
| 7,160,433 | B2 * | 1/2007 | Bennett | 205/734 |
| 2004/0238376 | A1 | 12/2004 | Whitmore | |
| 2005/0077191 | A1 | 4/2005 | Whitmore | |
| 2006/0251954 | A1 * | 11/2006 | Merzougui et al. | 429/44 |

OTHER PUBLICATIONS

Kuehn S et al "Impregnation of nickel foils with nanocrystalline certia as anodes for solid oxide fuel cells SOFC" Cerqamic Engineering and Science Proceedings (2003), 24(3) 27th International Cocoa Beach Conference of Advanced Cereamics and Composites 2003 Part A pp. 305-310.
Vector Brochure (3 pages).
The Euclid Chemical Company Brochure (4 pages).

* cited by examiner

*Primary Examiner*—Bruce F Bell
(74) *Attorney, Agent, or Firm*—Adrian D. Battison; Michael R. Williams; Ryan W. Dupuis

(57) ABSTRACT

An anode for use in cathodic protection of steel in concrete is formed from an electrically conductive material such as zinc and an ionically conductive material which is preferably a humectant and/or has a pH greater than 12 to enhance current flow. The materials are intimately intermixed through at least a part of the anode body and compressed into the anode body with an electrical connecting lead formed into a core of the body which is wholly conductive material. Portions of the electrically conductive material are pressed into electrical contact to form a plurality of electrically conductive paths within the anode body. Many of the voids in the body are interconnected to form a plurality of ionically conductive paths through the anode body by causing the humectant to migrate through the voids. The large surface area between the ionically conductive paths and the electrically conductive paths increase significantly the contact surface area of the anode body to increase current flow.

37 Claims, 4 Drawing Sheets

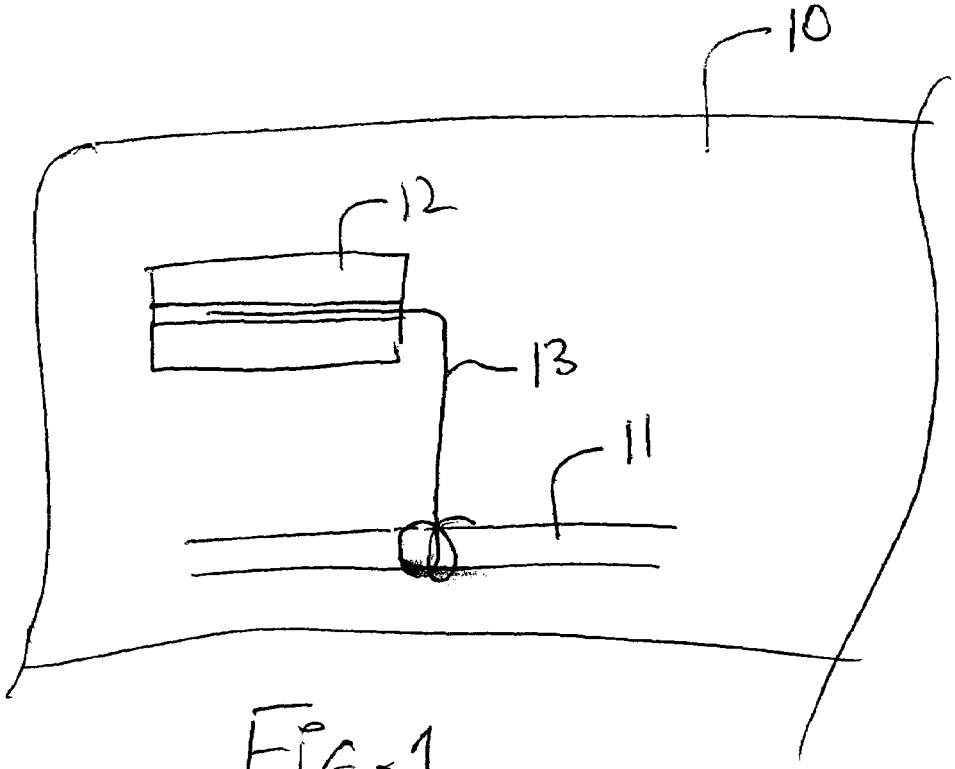
FIG. 1
FIG. 2
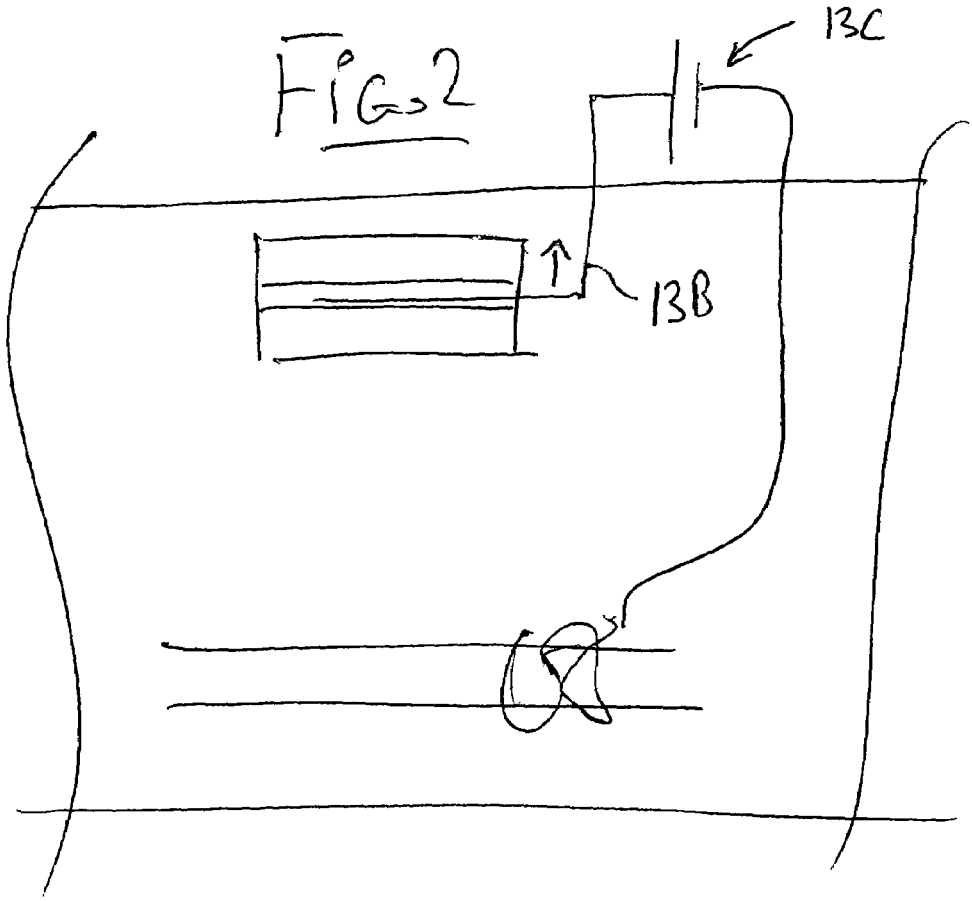

ANODE FOR CATHODIC PROTECTION

This invention relates to an anode for use in cathodic protection of a cathode in a medium, for example a structural steel member in a layer of concrete or mortar.

BACKGROUND OF THE INVENTION

In U.S. Pat. No. 6,572,760 of the present inventor there is disclosed an anode for use in cathodic protection of steel members in concrete using sacrificial anodes to generate a current which acts to reduce corrosion of the steel or otherwise to effect restoration of the concrete.

The anode disclosed is formed of a mixture of zinc powder or particles which are pressed together with a quantity of a humectant which is also in powder form so as to create an anode body which is an intimately mixed structure. This provides a material in the anode itself which acts to enhance the current flow and also forms voids or pores where corrosion products can be absorbed. An alternative manufacture technique is also disclosed in which the powder is applied on one side of a sheet or between sheets of the zinc foil which is or are rolled to form the anode body.

The anode is shaped into a suitable body shape for use in concrete which can be a puck shaped body or strips or flat elements as required. These bodies form a particular exterior surface of a prescribed surface area which is in ionic contact with the medium. Some shapes have been designed which may increase the surface area in contact with the concrete, but even the most complex shapes have an increased contact ratio only of the order of 2, that is, the surface area is twice that of a more simply formed body.

The present applicant also has the following issued patents and pending applications in USA, the disclosures of which are incorporated herein by reference or may be referred to for further details of cathodic protection systems with which the present invention is concerned:

U.S. Pat. No. 6,793,800 issued Sep. 21, 2004.

U.S. Pat. No. 6,165,346 issued Dec. 26, 2000.

U.S. patent application Ser. No. 2004 0238376 published Dec. 2, 2004.

U.S. patent application Ser. No. 2005 0077191 published Apr. 14, 2005.

In International Publication WO98/16670 of Bennett and Clear which corresponds to U.S. Pat. No. 6,033,553 issued Mar. 7, 2000 is disclosed another cathodic protection system intended to be used as a surface arrangement. This arrangement relates to a thinly sprayed zinc or zinc alloy which is applied onto the surface of the concrete. This zinc or zinc coating is then used as an anode to supply current for the cathodic protection process. As the anode is exposed at the surface, this may be used either as a sacrificial system in which there is no applied current and the anode is gradually eroded as the electrolytic process proceeds or as an impressed current cathodic protection system. The improvement of the above Bennett application relates to the application of a humectant in free-flowing form which is positioned at the interface between the zinc anode coating and the concrete surface. It has been found and is disclosed in this application that the provision of the humectant in free-flowing form acts to absorb moisture from the area above the surface.

SUMMARY OF THE INVENTION

It is one object of the invention to provide an anode body which has an increased current flow.

According to one aspect of the invention there is provided an anode for use in cathodic protection of a cathode in a medium comprising:

an anode body;

the anode body being shaped and arranged such that it can be installed with at least one exterior surface in contact with a medium which is in contact with a cathode to be protected;

the anode body comprising an electrically conductive material and an ionically conductive material;

an electrical connecting lead electrically connected to the electrically conductive material of the anode body for connection to the cathode;

the electrically conductive material and the ionically conductive material being intermixed through at least a part of the interior of the anode body;

the electrically conductive material being arranged in the anode body to define at least one electrically conductive path in the anode body and communicating to the connecting lead;

the ionically conductive material being arranged in the anode body to define at least one ionically conductive path extending from the at least one exterior surface of the anode body into the interior of the anode body;

the at least one ionically conductive path in the interior of the anode body being arranged to contact interior locations on the at least one electrically conductive path within the interior of the anode body so as to define a surface area of contact therebetween within the interior of the anode body.

According to a second aspect of the invention there is provided an anode for use in cathodic protection of a cathode in a medium comprising:

an anode body;

the anode body being shaped and arranged such that it can be installed with at least one exterior surface in contact with a medium which is in contact with a cathode to be protected;

the anode body comprising an electrically conductive material and an ionically conductive material;

an electrical connecting lead electrically connected to the electrically conductive material of the anode body for connection to the cathode;

the electrically conductive material and the ionically conductive material being intermixed through at least a part of the interior of the anode body;

the electrically conductive material being arranged in the anode body to define at least one electrically conductive path in the anode body and communicating to the connecting lead;

the ionically conductive material being arranged in the anode body to define at least one ionically conductive path extending from the at least one exterior surface of the anode body into the interior of the anode body;

the at least one ionically conductive path in the interior of the anode body being arranged relative to the at least one electrically conductive path within the interior of the anode body so as to define a surface area of contact therebetween through which the current passes which is more than five times larger than the at least one exterior surface.

This construction has the advantage that ions can flow through the ionically conductive path or paths between the medium and the surface of the electrically conductive material within anode the body so that these paths significantly increase the surface area of the electrically conductive material at which ions can be formed from a nominal surface area of exterior surface of the anode body by a contact ratio of at least 5. The contact ratio can be greater than 10 or even greater than 100, so that the amount of current is dramatically increased. This is orders of magnitude greater than can be achieved by shaping the surface or forming the surface using different techniques.

The medium can be any material which allows corrosion of steel or other structural members in the medium. The present invention is particularly concerned with concrete or mortar materials and steel members therein since this is a well known problem area leading to corrosion of the steel and consequential breakdown of the concrete. However the same principles may be used in other media and for protecting other cathodes.

The medium usually is separate from the ionically conductive material in the anode body in that it is not intended that the medium enter the anode body to form the paths therein. Generally the ionically conductive material can be formed at least partially from salts or polymers which can be humectant in nature and can be alkali. It will be appreciated therefore that the ionically conductive material can be formed from a cementitious material.

The principles disclosed herein are primarily but not necessarily concerned with sacrificial systems where there is no impressed current since these systems have more limitations due to a limited level of current output from an anode. However the principles can also be used with impressed current systems particularly in applications where space availability for installation of the anodes is limited.

Preferably the ionically conductive path or paths include at least portions thereof which extend laterally relative to the exterior surface within the anode body into connection with the electrically conductive material. That is, in general the paths extend in two or three dimensions in the body. Depending on the method of manufacture, the paths may be random or may be generally parallel to and at right angles to the exterior surface.

Preferably the ionically conductive paths have interconnecting portions within the anode body.

Preferably the anode body is shaped and arranged to be embedded in the medium with a plurality of exterior surfaces arranged for contacting the medium. However the invention can also be used with anodes intended for surface mounting so that the anode has in effect only one exterior surface intended to contact the medium.

Preferably the ionically conductive material is coated onto surfaces of the portions of the electrically conductive material at voids in the anode body so that the ionically conductive material extends from one void to the next to form in effect a continuous path from the exterior surface to the location within the anode body where it connects with the electrically conductive material. If the paths are broken they cannot of course communicate the ions between the medium and the electrically conductive material within the anode body and thus do not contribute to the available surface area.

In some cases this forms an anode body with voids which are not filled and therefore are free from the ionically conductive material. In order for these void areas to become effective, a continuous ionic path or series of paths need to be created from the exterior of the anode body into these interior locations. This arrangement can be obtained by the ionically conductive material being deposited from solution so that it extends from one space to the next by the solution wicking between the spaces during the manufacture until the solvent is dried leaving the ionically conductive material deposited. However other techniques may be used for generating continuity in the ionically conductive material paths in the anode body. For example this can be done by causing migration of the ionically conductive material or by application of an ionic gel or paste directly to the sheet. Void areas which remain can provide areas for containing the corrosion products which are greater in volume than the sacrificial metal. This is an important feature since the corrosion occurs within and generally throughout the anode body rather than just at the exterior surface.

In one preferred arrangement, the ionically conductive material is a humectant and has a pH greater than 12 since these are known to enhance the current level.

In another alternative arrangement, the ionically conductive material has a pH less than 4.5 and is contained within the anode body such that the outer surface of the anode body acts as a pH barrier.

As the amount of surface area is dramatically increased with a consequential increase in available current, it may be desirable to decrease the effect of other current enhancement techniques for purposes of increased life. For example, the ionically conductive material may be a mixture of a first ionically conductive material which is both a humectant and which is selected to maintain a high level of anodic activity at the surface and one or more ionically conductive or non-conductive materials which are selected not to maintain a high level of anodic activity at the surface.

Preferably the anode body has a core connected to the lead which core is formed substantially wholly of the electrically conductive material so as to be free from the ionically conductive material. This can be used to ensure that the required electrical connection to the lead is properly maintained during the life of the anode and is not affected by the presence of the ionically conductive material which is not electrically conductive.

In a particularly preferred manufacturing technique, the anode body is formed from overlying layers of conductive material, such as foil, with the ionically conductive material between the layers, which layers and the ionically conductive material are rolled around an axis and optionally compressed. This ensures effective electrical connection through the structure since the sheets or layers are continuous and yet provides the necessary spaces and paths through the body for the ionically conductive material.

After rolling the layers may be compressed either axially or in other directions.

Preferably the layers are perforated so as to define some of the paths through the layers.

As an alternative however, the anode body may be formed from particles of the electrically conductive material and the ionically conductive material. These materials may then be compressed together. Other techniques can also be used using different starting material such as flakes, ribbons, wires, or sheets of the electrically conductive material.

The anode is preferably a member formed in advance for application into or onto the medium as a finished anode so that its structure and construction is completed prior to installation. In this case it generally will have a thickness of the anode body from the at least one exterior surface to an opposed surface of at least 0.5 cms.

The principles of the invention can be applied to either sacrificial or impressed current systems. In an arrangement where the electrically conductive material is formed of a non-sacrificial material such that the current is applied as an impressed current, the ionically conductive material may have the property of providing an alkali environment to buffer acid given off by the electrically conductive material.

According to a third aspect of the invention there is provided a method for cathodic protection of a cathode in a medium comprising:

providing an anode body;

installing the anode body with at least one exterior surface of the anode body in contact with a medium which is in contact with a cathode to be protected;

the anode body comprising an electrically conductive material;

connecting an electrical connecting lead from the electrically conductive material of the anode body to the cathode;

the electrically conductive material being arranged in the anode body to define at least one electrically conductive path in the anode body and communicating to the connecting lead;

intermixing with the electrically conductive material of the anode body through at least a part of the interior of the anode body an ionically conductive material;

arranging the ionically conductive material in the anode body to define at least one ionically conductive path extending from the at least one exterior surface of the anode body into the interior of the anode body;

and arranging the at least one ionically conductive path in the interior of the anode body to contact interior locations on the at least one electrically conductive path within the interior of the anode body so as to define a surface area of contact therebetween through which the current passes in addition to flow of current through the at least one exterior surface.

Preferably the ionically conductive material is intermixed with the electrically conductive material prior to the installing of the anode body in the medium. However as an alternative, the ionically conductive material may be infused or leached into the anode body as part of or subsequent to the installation process.

Preferably also the ionically conductive material is arranged to form the at least one ionically conductive path in the interior of the anode body to contact the interior locations on the at least one electrically conductive path prior to the installing of the anode body in the medium. However, while the ionically conductive material may be present in the anode body prior to installation, it may be caused by wetting to diffuse through the body as part of or subsequent to the installation process.

Preferably the anode body is formed by providing interconnected voids between the electrically conductive material; locating the ionically conductive material in the voids; and causing some of the ionically conductive material to migrate through the voids so as to define the at least one ionically conductive path.

In this arrangement, the ionically conductive material is conveniently in solution while migrating such that the solution coats the surface of the voids and wicks through the voids leaving the ionically conductive material in the voids when the material comes out of solution. However the ionically conductive material can be supplied in any form such as gel or semi-liquid material which can migrate to ensure complete paths through the anode body rather than merely pockets of ionically conductive material which are not connected and thus cannot conduct the ions through the body to the medium at the surface.

However an alternative method can be used in which the porous body is pre-formed of the electrically conductive material such as zinc with the ionically conductive material omitted and subsequently the ionically conductive material is infused or leached in solution into the paths and spaces in the body. This is preferably done as a manufacturing technique before the body is installed but in some cases it may be done in situ in or on the medium.

BRIEF DESCRIPTION OF THE DRAWINGS

One embodiment of the invention will now be described in conjunction with the accompanying drawings in which:

FIG. 1 is a schematic illustration of a cathodic protection system utilizing a sacrificial anode.

FIG. 2 is a schematic illustration of a cathodic protection system utilizing an impressed current.

In the drawings like characters of reference indicate corresponding parts in the different figures.

DETAILED DESCRIPTION

Figure 3:
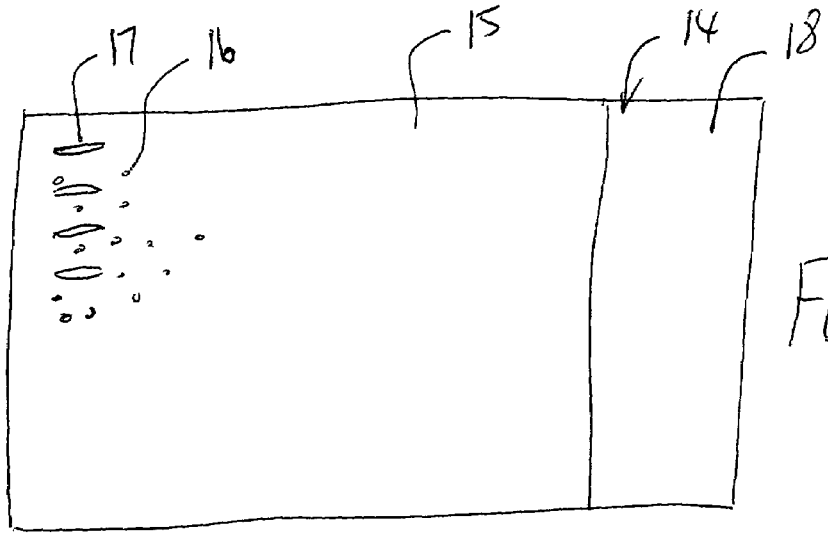
FIG. 3 is a top plan view of a sheet of foil which is arranged for use in manufacturing an anode according to the present invention.
Figure 4:
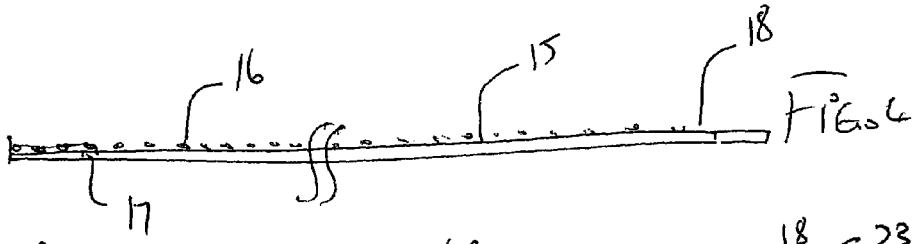
FIG. 4 is a side elevational view of the sheet of FIG. 3.

In FIG. 1 is shown a cathodic protection system for a medium 10 in which is embedded a cathode 11 and an anode 12. The anode 12 is of a sacrificial material which is electronegative relative to the cathode 11 and is connected to the cathode 11 by a lead 13.

Generally the present invention is concerned with the protection of reinforced concrete where the medium 10 is a layer of concrete and the cathode 11 is a steel element which is within the concrete medium, is partly embedded in the concrete medium or is in contact with the concrete medium. The surface of the steel which is in contact with the concrete medium can corrode for reasons well known to persons skilled in the art.

The anode 12 is embedded in the medium so that it is in ionic contact with the medium so that ions within the medium transfer between the anode and the cathode while electrons form a current passing through the electrical lead 13. This circuit therefore as is well known protects the steel and reduces or prevents corrosion of the steel.

One problem which has arisen with arrangements of this type is that of generating sufficient current between the anode and the cathode and to maintain that current over a significant period of time.

The arrangement of the present invention provides an anode which has generally a series of electrically conductive paths within the body of the anode which are interspersed with ionically conductive paths within the anode so that there is a dramatically increased surface area between these paths through which the current can pass.

Up until now the communication of the current has in effect occurred through the exterior surface of the anode body and attempts have been made to increase this surface area of this exterior surface. However in the present invention the exterior surface provides some of the contact between the medium and the electrically conductive material while the ionically conductive paths within the body itself allow ions to transfer through those paths and communicate with the electrically conductive paths within the body.

One technique for manufacturing an anode of this type is shown in FIGS. 3 through 7. In this technique, a sheet of a suitable sacrificial anode material such as zinc is laid flat and is coated over a first area 15 of the sheet 14 with a layer of particles 16 of an ionically conductive material. Sheet 15 is formed with perforations 17 which can be in the form of slots or holes. The slots or holes cover at least the portion 15 of the sheet 14. A further portion 18 of the sheet 14 is free from the particles 16 so that the sheet consists solely of the sacrificial anode material in the area 18.

Figure 5:
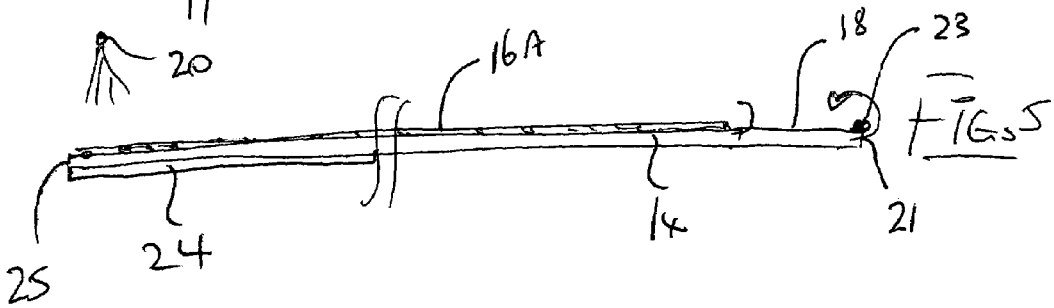
FIG. 5 is a side elevational view similar to that of FIG. 4 showing a further step in the process.

In the step shown in FIG. 5, in a first action water, or other solvent such as a water based solution, from a spray nozzle 20 is applied onto the layer of the particles 16 so as to wet those particles. This has two effects. Firstly it assists in adhering the particles to the sheet 14. Secondly it supplies a solvent which acts to dissolve part of the ionically conductive material which is generally soluble in water. Thus after the application of the water or the solvent from the nozzle 20, there is a layer 16A on the surface of the sheet 14 which forms a solution of the ionically conductive material from the particles 16. This layer 16A extends over the area 15 and is prevented from entering the area 18 so that the area 18 remains bare. Alternatively the water or solvent may be applied first and the salts second. Alternatively the salts may be in the solution, gel or paste and applied as a single application.

Figure 6:
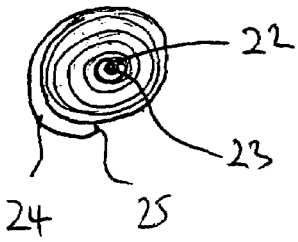
FIG. 6 is a side elevational view similar to that of FIGS. 4 and 5 showing a rolled anode structure.

With the sheet 14 in this arrangement as shown in FIG. 5, the edge 21 of the sheet is turned upwardly and rolled in the form of a spiral roll to form the construction shown in FIG. 6. As the sheet is bare in the area of the edge 21 and into the area 18, a first portion or core of the spiral roll as indicated at 22 is free from the ionically conductive material in the layer 16A. This forms a core 22 of the spiral roll which wraps around one or more wires 23 of the anode structure with the wire or wires 23 being applied at the edge 21 prior to the rolling to form the lead 13 of the anode body. The lead 13 as defined by the wire or wires 23 projects outwardly from one end or both ends of the rolled structure. The lead extends into the rolled structure and lies along the edge 21 so as to form an electrical contact with the edge 21 and the portion of the sheet 14 wrapped around that wire. The wire 14 may be a bare conductor or may carry a surrounding layer of the sacrificial anode material which thus forms part of the core 22. The wire or the layer of the sacrificial anode material may be welded or otherwise attached to the edge of the sheet for improved electrical connection. The core 22 defined by the wire and by the surrounding layer of anode material in the absence of the ionically conductive material thus forms a body around the wire 23 which is wholly of electrically conductive material so as to provide an effective initial communication of current from the wire 23 into the body of the anode. As there is no conduction of ions into the core, the core does not corrode and therefore electrical connection to the wire is maintained more effectively during the corrosion of the anode body in the areas outside the core.

The sheet 14 is rolled into the area 15 thus rolling into the structure in spiral form the layer 16A. Thus the core 22 is surrounded by alternate layers of the sheet and the layer 16A which are rolled into a spiral. These alternate layers can communicate through the sheet by way of the perforations 17 so that each layer of the ionically conductive material defined by the 16A is in communication with the next adjacent layer through the space provided in the sheet 14 by the perforations 17.

An optional reinforcement layer 24 can be provided which is engaged onto the outside surface of the sheet 14 in the area of that sheet approaching the opposite end edge 25 which forms the outermost portion of the sheet 14 when rolled. The reinforcing layer 24 has a width equal to that of the sheet and a length sufficient so that it wraps around at least one or two of the turns of the spiral when formed as shown in FIG. 6.

Figure 7:
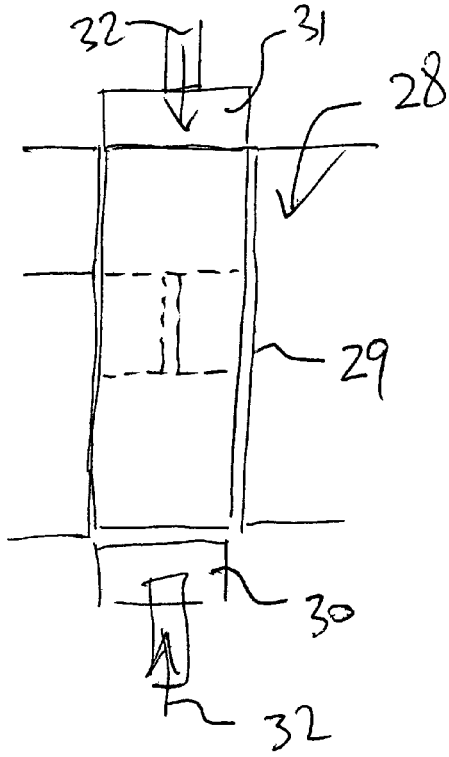
FIG. 7 is a schematic illustration showing the compression of the anode structure of FIG. 6.

In the next step of the process shown in FIG. 7, the spiral so formed is placed into a press 28 which contains the cylindrical form of the spiral with a cylindrical wall 29 and includes compressing pistons 30 and 31 which are moved inwardly by suitable compression actuators 32 so as to compress the spiral axially to reduce the length of the spiral. It will be appreciated that this compression distorts the layer 14 so that it becomes distorted out of its spiral pattern and can fold and crease to form generally random patterns.

During this compression the particles 16 are retained within the structure by the solvent. During the compression the solution containing the ionically conductive material and the particles, if any, of the ionically conductive material remain in a layer on one surface of the sheet 14. These materials are therefore compressed into the interstices between the portions of the electrically conductive material as they are folded and creased during the compression action. In addition air may be present in some of the locations between the portions of the sheet so as to form voids. All of the air or some of the solution may be expelled during the compression. However in the resultant compressed product there will be in most cases some particles, some air and some solution.

The electrically conductive material or metal will be compressed at places so that it contacts other portions of the metal through the structure forming a myriad of little paths through the structure from the external surface through to the wire. In between these little paths will be some solution, some voids and some particles, in most cases. The solution is free to migrate through the interstices so that it will tend to wick into the interstices filling or partly filling most or all of the interstices. This movement is of course assisted by the compression.

After the compression is complete, some solution will tend to escape from the body but most will remain in place and will tend to dry as the solvent dries off over a period of time. During the drying process, the ionically conductive material will tend to deposit out of solution onto the surfaces of the interstices thus coating all of the surfaces and providing a path through those interstices onto substantially all or most of the metal surfaces within the interior structure of the anode body. Thus there will be formed within the anode body a series of ionically conductive paths defined by the ionically conductive material which has been deposited out of solution and the remaining particles of ionically conductive materials.

Thus the finished anode body has within its structure a series of electrically conductive paths in communication with a series of ionically conductive paths defining between them a surface area which is significantly greater than the simple exterior surface of the structure itself. This increase in surface contact through the series of internal passages and paths can be greater than 100 times the simple exterior surface of the anode body and certainly will be greater than 10 times or greater than 5 times, depending upon the method of construction.

It will of course be appreciated that the surface area depends upon the thickness of the foil so that thinner foil will generate for a certain volume a much larger number of interstices and surface area since the surface area of the initial foil from which the structure is formed is much greater. Foil of different thicknesses can be used and the thickness of the foil may lie in the range 0.001 to 0.050 inch and more preferably in the range 0.003 to 0.020 inch.

The ionically conductive material may contain or consist of materials which enhance the effectiveness of the current from the anode. As set forth in a number of the previous patents, materials which are humectants can assist in the generation of current since they tend to absorb and maintain moisture in the area of the surfaces concerned. The whole of the ionically conductive material may therefore be formed from a humectant material of which many examples are known in the prior art or the material may consist of a mixture of humectant and other non-humectant materials. A further characteristic which enhances current is that of providing a material which has a relative high pH generally greater than 12. Again this concept is known in the prior art and the ionically conductive material may be chosen in order to provide such a high pH within the anode body. Other enhancement materials may also be provided as part of or a characteristic of the ionically conductive material. As a yet further alternative, the material may have a relatively low pH since the material may be contained within the anode and thus the outer surface of the anode acts as a pH barrier.

The provision of the perforations within the sheet 14 ensures that the ionically conductive paths are also formed from separate path portions within the anode body which are interconnected by the perforations and thus pass through the layer defined by the sheet 14 back and forth.

Figure 9:
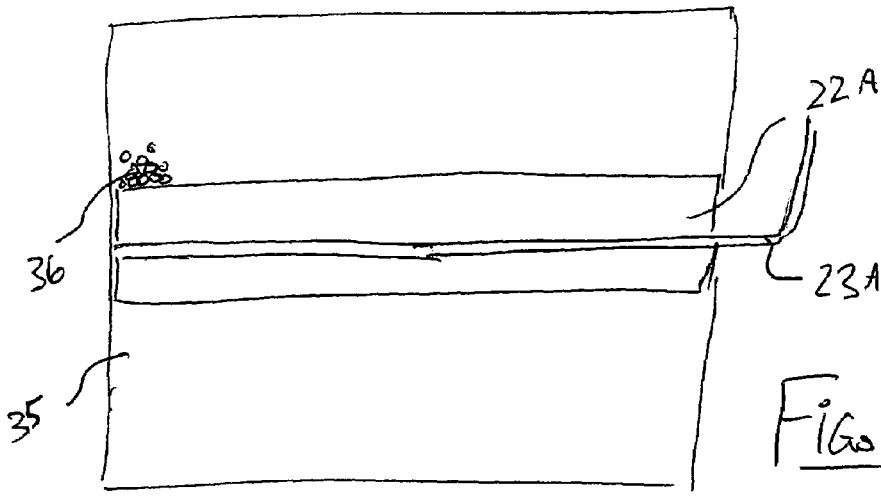
FIG. 9 is a cross sectional view through an anode according to the present invention formed using an alternative technique.
Figure 10:
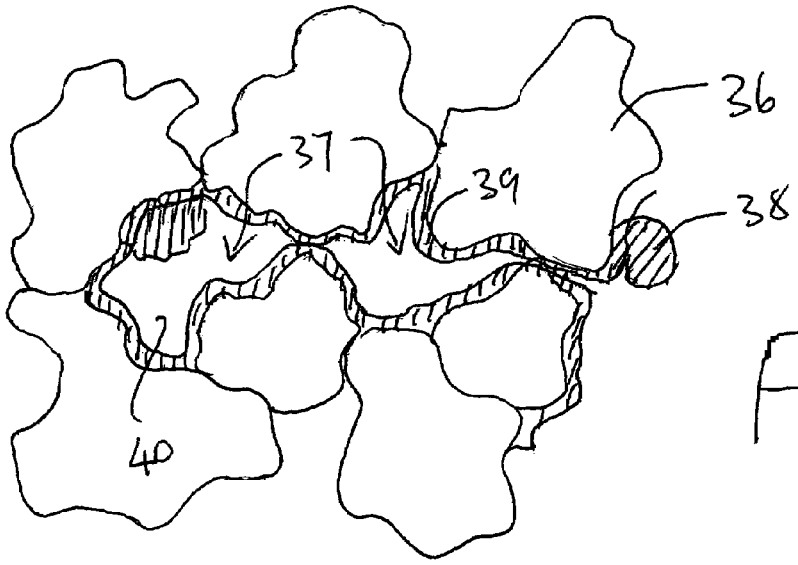
FIG. 10 is a view showing a small portion of the anode of FIG. 9 on an enlarged scale showing the electrically conductive paths and the ionically conductive paths.

In FIGS. 9 and 10 is shown an alternative construction of the anode body which is defined by compressing particles of the electrically conductive material and the ionically conductive material. Thus in FIG. 9 there is shown a wire 23A which extends into a core 22A of a cast portion of the metal. Around the exterior of this core is applied a body 35 which is defined by compressed particles as indicated at 36.

The particles may be generally amorphous or may have a shape such as a flake or small piece of sheet since it will be appreciated that the compression of any such object will provide the necessary interstices containing the ionically conductive material in solid, gel or solution form.

FIG. 10 shows schematically a series of metal particles 36 between which are interstices 37. The ionically conductive material is shown in cross hatch and includes particles 38 and deposited materials 39 which coats on the surfaces of the particles 36. Some of the interstices are filled with a particle and some have voids as indicated at 40.

As previously described in the prior art, the voids can accommodate expansion of the anode body caused by the corrosion of the individual particles. It will be appreciated that the corrosion occurring due to the sacrificial nature of the metal particles 36 takes place at the surface of each particle causing that particle to expand as corrosion occurs. The corrosion materials which are of a greater volume than the original material can thus expand into the voids 40 thus avoiding significant expansion of the anode body itself at its exterior surface.

As an example the content of the anode body may have a range as follows:

Zinc 50 to 90% by weight;

Ionically conductive material 10 to 40% by weight;

Void 3 to 30% by volume.

In another alternative arrangement, the ionically conductive material has a pH less than 4.5 and is contained within the anode body such that the outer surface of the anode body acts as a pH barrier. The use of low pH material in the anode body can provide a significant enhancement of the flow of current but is normally unacceptable in view of its detrimental effect on the concrete surrounding the anode. However in this arrangement the low pH material is contained within the anode body and thus is prevented from accessing and degrading the concrete.

Figure 8:
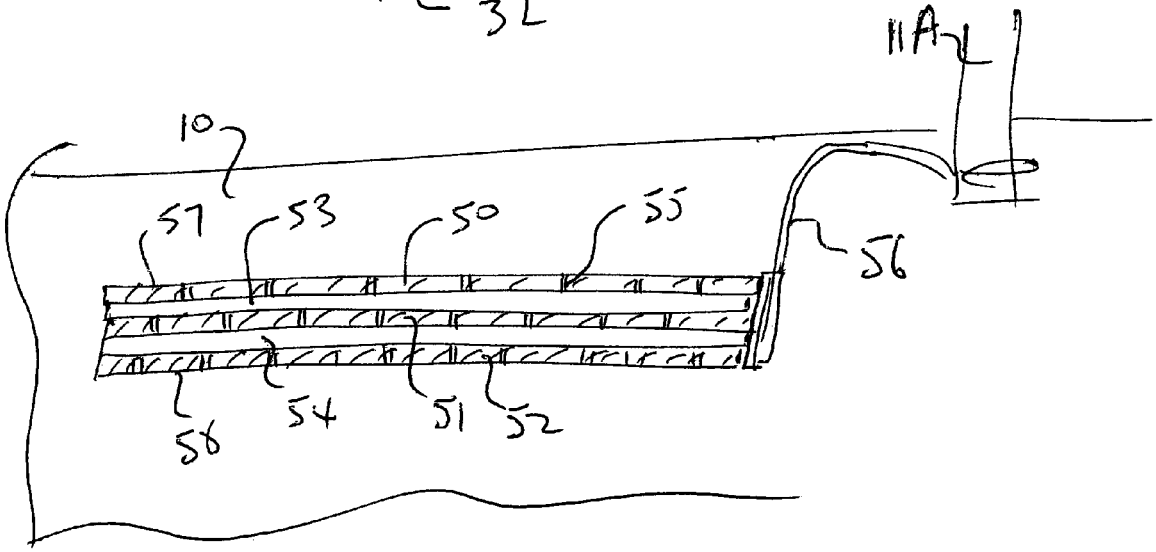
FIG. 8 is a schematic side elevational view of an alternative construction of anode for use in a cathodic protection system.

Turning now to FIG. 8 there is shown an alternative embodiment which is formed by individual layers 50, 51, 52 etc. of the electrically conductive material. In between each layer and the next is provided a layer 53, 54 etc. of the ionically conductive material. Each sheet of the zinc or other material is perforated as indicated at 55.

Even though this structure is not compressed and remains in simple overlying form, the provision of the perforations 55 ensures that there are a series of ionically conductive paths from the exterior of the body through the interior of the body communicating at a plurality of separate locations within the body with the electrically conductive path or paths through the body leading to the wire 56. Each of the ionically conductive paths communicates with the exterior of the body through the perforations 55. It will be appreciated that it is necessary for the ionically conductive paths to communicate with the exterior surfaces as indicated at 57 and 58 of the anode body in order that the ions can flow through the medium 10 and through the ionically conductive paths into engagement with the electrically conductive path or paths within the interior of the anode body. Thus the exchange occurs within the anode body throughout much of the surfaces of the metal since the ions can communicate from the medium 10 through the ionically conductive paths to those surfaces. The electrons from the metal surface of course pass to the wire 56 which is connected to a steel reinforcement member as indicated at 11A. In the embodiment of FIG. 1, the reinforcement element 11 is a rebar within the concrete. In the embodiment of FIG. 8, the metal element 11A is a structural member which extends from contact within the concrete to a position outside the concrete such as a deck rail or the like so that the portion buried in the concrete can be protected from corrosion.

The perforations in the sheets are not essential and the sheets may be imperforate. In such a case the ionically conductive paths to the separate locations in the interior of the body must pass along the sheets to the ends of the sheets. While this increases the distance, the selection of an ionically conductive material which reduces the resistance to current flow to a level significantly below that of concrete (or the medium) will reduce the deleterious effect of this increased distance.

In a further alternative arrangement including a medium and a reinforcing steel member the anode body can be laid on a top surface of the medium or concrete and is covered by a floor covering layer. This arrangement can be used with the other types of structure previously described but is particularly applicable to the layer arrangement of FIG. 8 where a construction of multiple layers or thin foil may result in an anode body of the order of 0.05 to 0.25 inches in thickness.

The arrangements described hereinbefore are used with a sacrificial conductive material such as zinc so that the current is generated by galvanic action. However an impressed current system is shown in FIG. 2 where the anode body is connected through the wire 13B to a power supply generally indicated at 13C. In this arrangement the anode body is formed from a conductive material which is not sacrificial but is intended to be maintained. Such anode bodies are typically of titanium since there is little or no corrosion of such material within the system. However the same arrangement of paths of electronically conductive material and paths of ionically conductive material provide a significantly increased surface area within the anode body for the communication of the current through the anode body.

The anode used in the impressed current system is particularly of advantage in a situation where a limited volume anode is required. Thus it will be appreciated that the amount of current can be controlled by the voltage from the power source 13C. However there is a limit on the current density that can flow and a limit on the voltage of the power source since the current cannot be sufficient as to generate unacceptable deterioration of the anode/medium interface and cannot be sufficient that there is significant voltage drop across the interface or through the conductors. In a situation therefore where there is limited volume available for the anode, the highly concentrated anode structure of the present invention can be used in an impressed current system.

The ionically conductive material used with the impressed current system can advantageously be selected so that it provides an alkali environment to buffer acid given off by the electrically conductive material and to allow gas generated to diffuse away. It is well known that impressed current systems used with non-sacrificial anodes give off as part of the electrolytic action an acid at the anode which can cause localized breakdown of the concrete where the acid interferes with the alkali nature of the concrete. Thus the provision of an alkali in the ionically conductive material which is arranged to buffer the acid production is advantageous in preventing these problems.

Similarly, these anodes give off gas as part of the electrolytic action. The provision of a porous ionically conductive medium and anode structure is beneficial in allowing the gas generated to diffuse away.

While the system of the present invention can be used as a surface contact on the surface of the medium, it is generally preferred that the anode body be embedded within the structure. Such embedded anodes as indicated in FIGS. 1 and 2 thus provide a number of exterior surfaces which contact the medium since both the top and bottom surfaces and any side surfaces contact the medium. In such an arrangement the anode body generally has a thickness which is greater than 0.5 centimeters and can be as much as 3 centimeters or greater to provide sufficient volume and sufficient internal contact surface to generate the currents required in the system and to maintain those currents over an extended period of time.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An anode assembly for use in cathodic protection of a cathode in a medium comprising:

an anode body;

the anode body being shaped and arranged to define at least one exterior surface arranged for contacting medium which is in contact with a cathode to be protected;

the anode body comprising an electrically conductive material and an ionically conductive material;

and an electrical connecting lead electrically connected to the electrically conductive material of the anode body for connection to the cathode;

the electrically conductive material being arranged in the anode body to define a plurality of electrically conductive paths in the anode body and communicating from the connecting lead to the at least one exterior surface;

the ionically conductive material being arranged in the anode body to define a plurality of ionically conductive paths extending from the at least one exterior surface of the anode body, where the ionically conductive material is exposed for engaging the medium, into the interior of the anode body;

the plurality of ionically conductive paths from at least one exterior surface into the interior of the anode body being separated one from a next by portions of the electrically conductive material and being arranged to contact interior locations on at least one of the plurality of electrically conductive paths within the interior of the anode body so as to define a surface area of contact therebetween within the interior of the anode body.

2. The anode assembly according to claim 1 wherein the anode body has voids therein which are empty of the ionically conductive material between portions of the electrically conductive material.

3. The anode assembly according to claim 1 wherein there are spaces within the interior of the anode body between the electrically conductive material where at least some of the spaces partly contain the ionically conductive material in contact with the electrically conductive material with the ionically conductive material extending from one space to the next to define the at least one ionically conductive path.

4. The anode assembly according to claim 1 wherein the ionically conductive material includes a humectant.

5. The anode assembly according to claim 1 wherein the ionically conductive material includes at least parts which have a pH greater than 12.

6. The anode assembly according to claim 1 wherein the ionically conductive material has a pH less than 4.5.

7. The anode assembly according to claim 1 wherein the anode body has a core connected to the lead which core is formed substantially wholly of the electrically conductive material so as to be free from the ionically conductive material.

8. The anode assembly according to claim 1 wherein the electrically conductive material and the ionically conductive material are compressed together.

9. The anode assembly according to claim 1 wherein the surface area of contact between the at least one electrically conductive path and the at least one ionically conductive path in the interior of the anode body through which the current passes is at least 5 times the surface area of the at least one exterior surface.

10. The anode assembly according to claim 9 wherein the surface area is at least 10 times that of the at least one exterior surface.

11. The anode assembly according to claim 1 wherein the electrically conductive material comprises a sacrificial material which is more electro-negative than the cathode to be protected.

12. The anode assembly according to claim 1 wherein the electrically conductive material comprises a non-sacrificial material such that the current is applied as an impressed current.

13. The anode assembly according to claim 12 wherein the ionically conductive material includes an alkali to buffer acid given off by the electrically conductive material.

14. The anode assembly according to claim 12 wherein the ionically conductive material is porous to allow gas given off to diffuse.

15. An anode assembly for use in cathodic protection of a cathode in a medium comprising:

an anode body;

the anode body being shaped and arranged to define at least one exterior surface arranged for contacting a medium which is in contact with a cathode to be protected;

the anode body comprising an electrically conductive material and an ionically conductive material;

and an electrical connecting lead electrically connected to the electrically conductive material of the anode body for connection to the cathode;

the electrically conductive material being formed from particles of the electrically conductive material which contact together in the anode body to define a plurality of electrically conductive paths in the anode body communicating to the connecting lead;

the particles of the electrically conductive material forming the plurality of electrically conductive paths leaving electrically non-conducting paths therebetween;

the ionically conductive material being arranged in the anode body to define in the electrically non-conducting paths a plurality of ionically conductive paths extending from the at least one exterior surface of the anode body, where the ionically conductive material is exposed for engaging the medium, into the interior of the anode body;

the ionically conductive paths in the interior of the anode body being arranged to contact interior locations on the electrically conductive paths within the interior of the anode body so as to define a surface area of contact therebetween within the interior of the anode body.

16. The anode according to claim 15 wherein the particles of the electrically conductive material are compressed together.

17. The anode according to claim 15 wherein the non-conducting paths include some voids which are at least partly empty of the ionically conductive material.

18. The anode according to claim 15 wherein the non-conducting paths form spaces within the interior of the anode body between the particles and wherein at least some of the spaces partly contain the ionically conductive material in contact with the electrically conductive material with the ionically conductive material extending from one space to a next to define the at least one ionically conductive path.

19. The anode assembly according to claim 15 wherein the surface area of contact between the at least one electrically conductive path and the at least one ionically conductive path in the interior of the anode body through which the current passes is at least 5 times the surface area of the at least one exterior surface.

20. The anode assembly according to claim 19 wherein the surface area is at least 10 times that of the at least one exterior surface.

21. The anode assembly according to claim 19 wherein the particles are flakes.

22. An anode assembly for use in cathodic protection of a cathode in a medium comprising:

an anode body;

the anode body being shaped and arranged to define at least one exterior surface arranged for contacting a medium which is in contact with a cathode to be protected;

the anode body comprising an electrically conductive material and an ionically conductive material;

and an electrical connecting lead electrically connected to the electrically conductive material of the anode body for connection to the cathode;

the electrically conductive material being formed from layers of the electrically conductive material which layers contact together in the anode body to define a plurality of electrically conductive paths in the anode body communicating to the connecting lead;

the ionically conductive material being located between at least some of the layers so as to form a plurality of ionically conductive paths extending from the at least one exterior surface of the anode body, where the ionically conductive material is exposed for engaging the medium, into the interior of the anode body;

the ionically conductive paths in the interior of the anode body being arranged to contact interior locations on the electrically conductive paths within the interior of the anode body so as to define a surface area of contact therebetween within the interior of the anode body.

23. The anode according to claim 22 wherein the layers are compressed together into contact.

24. The anode according to claim 22 wherein the layers contain voids therebetween which are empty of the ionically conductive material.

25. The anode according to claim 22 wherein the layers contain spaces therebetween and wherein at least some of the spaces partly contain the ionically conductive material in contact with the electrically conductive material with the ionically conductive material extending from one space to a next to define the at least one ionically conductive path.

26. The anode assembly according to claim 22 wherein the surface area of contact between the at least one electrically conductive path and the at least one ionically conductive path in the interior of the anode body through which the current passes is at least 5 times the surface area of the at least one exterior surface.

27. The anode assembly according to claim 26 wherein the surface area is at least 10 times that of the at least one exterior surface.

28. The anode assembly according to claim 22 wherein the layers are formed from sheets of foil.

29. The anode according to claim 22 wherein the layers of the electrically conductive material are perforated so as to define ionically conductive paths which extend through the layers.

30. An anode assembly for use in cathodic protection of a cathode in a medium comprising:

an anode body;

the anode body being shaped and arranged to define at least one exterior surface arranged for contacting a medium which is in contact with a cathode to be protected;

the anode body comprising an electrically conductive material and an ionically conductive material;

and an electrical connecting lead electrically connected to the electrically conductive material of the anode body for connection to the cathode;

the electrically conductive material being formed from layers of the electrically conductive material which layers contact together in the anode body to define a plurality of electrically conductive paths in the anode body communicating to the connecting lead;

the ionically conductive material being located between at least some of the layers so as to form a plurality of ionically conductive paths extending from the at least one exterior surface of the anode body, where the ionically conductive material is exposed for engaging the medium, into the interior of the anode body;

the ionically conductive paths in the interior of the anode body being arranged to contact interior locations on the electrically conductive paths within the interior of the anode body so as to define a surface area of contact therebetween within the interior of the anode body;

wherein the layers are rolled around an axis.

31. The anode according to claim 30 wherein the layers are compressed together into contact.

32. The anode according to claim 31 wherein the layers contain voids therebetween which are empty of the ionically conductive material.

33. The anode according to claim 32 wherein the layers contain spaces therebetween and wherein at least some of the spaces partly contain the ionically conductive material in contact with the electrically conductive material with the ionically conductive material extending from one space to a next to define the at least one ionically conductive path.

34. The anode assembly according to claim 30 wherein the surface area of contact between the at least one electrically conductive path and the at least one ionically conductive path in the interior of the anode body through which the current passes is at least 5 times the surface area of the at least one exterior surface.

35. The anode assembly according to claim 34 wherein the surface area is at least 10 times that of the at least one exterior surface.

36. The anode assembly according to claim 30 wherein the layers are formed from sheets of foil.

37. The anode according to claim 30 wherein the layers of the electrically conductive material are perforated so as to define ionically conductive paths which extend through the layers.

* * * * *